US008879929B2

(12) United States Patent
Ariizumi

(10) Patent No.: US 8,879,929 B2
(45) Date of Patent: Nov. 4, 2014

(54) IMAGE FORMING APPARATUS

(75) Inventor: Osamu Ariizumi, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 312 days.

(21) Appl. No.: 13/216,284

(22) Filed: Aug. 24, 2011

(65) Prior Publication Data

US 2012/0051763 A1 Mar. 1, 2012

(30) Foreign Application Priority Data

Aug. 27, 2010 (JP) ..... 2010-191575

(51) Int. Cl.
*G03G 15/02* (2006.01)
*G03G 15/00* (2006.01)

(52) U.S. Cl.
CPC ..... *G03G 15/0291* (2013.01); *G03G 15/5037* (2013.01)
USPC ..... 399/31; 399/248; 399/313; 399/170

(58) Field of Classification Search
USPC ..... 399/100, 135, 170, 248, 31
See application file for complete search history.

(56) References Cited

U.S. PATENT DOCUMENTS

2007/0059056 A1* 3/2007 Murayama et al. ..... 399/302
2010/0158571 A1* 6/2010 Kidaka et al. ..... 399/170

FOREIGN PATENT DOCUMENTS

JP 2007-072212 A 3/2007

* cited by examiner

*Primary Examiner* — Walter L Lindsay, Jr.
*Assistant Examiner* — Roy Y Yi
(74) *Attorney, Agent, or Firm* — Fitzpatrick, Cella, Harper & Scinto

(57) ABSTRACT

An image forming apparatus includes a photosensitive member; a corona charger, provided with an opening, for electrically charging the photosensitive member; a sheet-like shielding member for shielding the opening of the corona charger; a moving device for moving the shielding member in a longitudinal direction of the photosensitive member; a potential sensor for detecting a potential of a portion of the photosensitive member chargeable by the corona charger; and a controller for detecting, on the basis of a result of detection of the potential of the portion of the photosensitive member by the potential sensor, whether or not a charging operation capable of electrically charging the photosensitive member by the corona charger is performed in a state in which the shielding member is located between the opening of the corona charger and the photosensitive member.

4 Claims, 13 Drawing Sheets

IMAGE FORMING APPARATUS

FIELD OF THE INVENTION AND RELATED ART

The present invention relates to an image forming apparatus using an electrophotographic image forming process, such as a copying machine, a printer or a facsimile machine.

In the image forming apparatus using the electrophotographic image forming process, in general, as a primary charging means for uniformly charging an electrophotographic photosensitive member of a drum type (cylindrical type) (hereinafter referred to as a photosensitive drum) to a predetermined polarity and a predetermined potential, a corona charger (corona discharger) is generally used. The corona charger is provided opposed to the photosensitive drum in a non-contact manner and electrically charges the photosensitive drum uniformly to the predetermined polarity and potential by corona ions generated by the corona discharge.

Further, in the image forming apparatus using the electrophotographic image forming process, in addition to the above-described corona charger (primary charger) for uniformly charging the photosensitive drum, a plurality of corona chargers are used.

For example, there is the corona charger (pre-transfer charger) for enhancing a charge polarity of a toner image (toner) charged on the photosensitive drum. Further, there is the corona charger (transfer charger) for transferring the toner image from the photosensitive drum onto a transfer material (sheet). Further, there is the corona charger (separation charger) for removing the electric charge from the transfer material (sheet) on which the toner image is transferred, to separate the transfer material from the surface of the photosensitive drum.

These corona chargers generate corona (electric discharge) products such as ozone ($O_3$) or nitrogen oxides ($NO_x$) during operations thereof. These corona products act on electric discharge energy and gas and moisture in ambient air. By this action, on the surface of the photosensitive drum, nitrogen compounds and compounds having hydrophilic groups such as aldehyde group and carboxyl group are deposited. The deposited compounds absorb the moisture in ambient air, with the result that a surface resistance of the photosensitive drum is lowered to cause a so-called "image flow (deletion)" phenomenon such that an electrostatic latent image is partly lacking.

Incidentally, the corona product generated during the image forming operation and dropped on the photosensitive drum can be removed together with the toner by being carried to a cleaning device by a rotating operation of the photosensitive drum or can be removed at a filter portion by being carried to an air duct filter by air flow. As a result, the corona product is not deposited on the photosensitive drum, so that the image flow does not occur.

However, the corona product gradually deposited and accumulated on the corona charger (primary charger or the like) during the image forming operation is dropped from the corona charger onto the photosensitive drum during stop of the image forming apparatus, so that the corona product is deposited in a band-like shape below the corona charger. Particularly, during stop of the image forming apparatus for a long term or during standing all through the night, moisture absorption of the corona product deposited in the band-like shape sufficiently proceeds. For that reason, at an initial stage of the image forming operation or the like after the long-term stop of the image forming apparatus, the image flow such that the image is lacking in the band-like shape can occur.

One of factors of the image flow is the moisture absorption of the hydrophilic compound on the photosensitive drum but this moisture absorption can be prevented by keeping a surface temperature of the photosensitive drum at an ambient temperature or more.

As countermeasures to prevent the image flow phenomenon, the following proposals have been conventionally made.

(1) A heater is provided at an inner surface of the photosensitive drum (hereinafter referred to as a drum heater) and is always caused to generate heat during the image forming operation or during the stop of the image forming apparatus, so that the surface of the photosensitive drum is heated up to the ambient temperature or more to prevent the moisture absorption of the hydrophilic compound.

(2) Before the image forming operation, an idling operation for rotating the photosensitive drum is sufficiently performed and during long-term stop of the image forming apparatus the corona product deposited on the photosensitive drum is removed, and then the image forming operation is started.

(3) During the long-term stop of the image forming apparatus, a shielding member is inserted between the corona charger and the photosensitive drum in advance to prevent the deposited matter from dropping from the corona charger onto the photosensitive drum.

However, as in the countermeasure (1), in control in which the drum heater is always turned on, unnecessary electric power can be consumed. That is, as in the case where the image forming apparatus is in a low-humidity environment or in the case where the photosensitive drum is kept at a sufficient temperature during the image forming operation by heat from a fixing device, also in a state in which the image flow does not occur even when the drum heater is not used, the unnecessary electric power is consumed.

Further, in the countermeasure (2), a time of the idling for removing the corona product deposited during the long-term standing of the image forming apparatus is generally required to be several minutes. For that reason, this countermeasure is undesirable from the viewpoint of first copy output time (FCOT) from pressing of a copy button until a first recording image is outputted.

Therefore, as in the countermeasure (3), the use of the shielding member inserted between the control and the photosensitive drum (hereinafter referred to as a charger shutter) is effective from an economical viewpoint and also from the viewpoint of FCOT (Japanese Laid-Open Patent Application 2007-072212).

The charger shutter can be inserted between the corona charger and the photosensitive drum from either of end portion sides of the corona charger with respect to a longitudinal direction of the corona charger (rotational axis direction of the photosensitive drum). Further, as the charger shutter, from the viewpoint of ease of retraction or the like, a sheet-like shielding member is used.

The charger shutter is required to be completely retracted before the image forming operation and to be inserted between the corona charger and the photosensitive drum with reliability during the long-term stop of the image forming apparatus. However, as a detecting means for checking these states of the charger shutter, it is not preferable that a dedicated sensor or the like is provided, from the viewpoints of simplification of a constitution, downsizing and cost reduction.

SUMMARY OF THE INVENTION

A principal object of the present invention is to provide an image forming apparatus capable of detecting, with a simple constitution, that a charging opening is performed in a state in which a shielding member is located between an opening of a corona charger and a photosensitive member.

According to an aspect of the present invention, there is provided an image forming apparatus comprising:

a photosensitive member;

a corona charger, provided with an opening, for electrically charging the photosensitive member;

a sheet-like shielding member for shielding the opening of the corona charger;

moving means for moving the shielding member in a longitudinal direction of the photosensitive member;

a potential sensor for detecting a potential of a portion of the photosensitive member chargeable by the corona charger; and control means for detecting, on the basis of a result of detection of the potential of the portion of the photosensitive member by the potential sensor, whether or not a charging operation capable of electrically charging the photosensitive member by the corona charger is performed in a state in which the shielding member is located between the opening of the corona charger and the photosensitive member.

These and other objects, features and advantages of the present invention will become more apparent upon a consideration of the following description of the preferred embodiments of the present invention taken in conjunction with the accompanying drawings.

Figure 4:
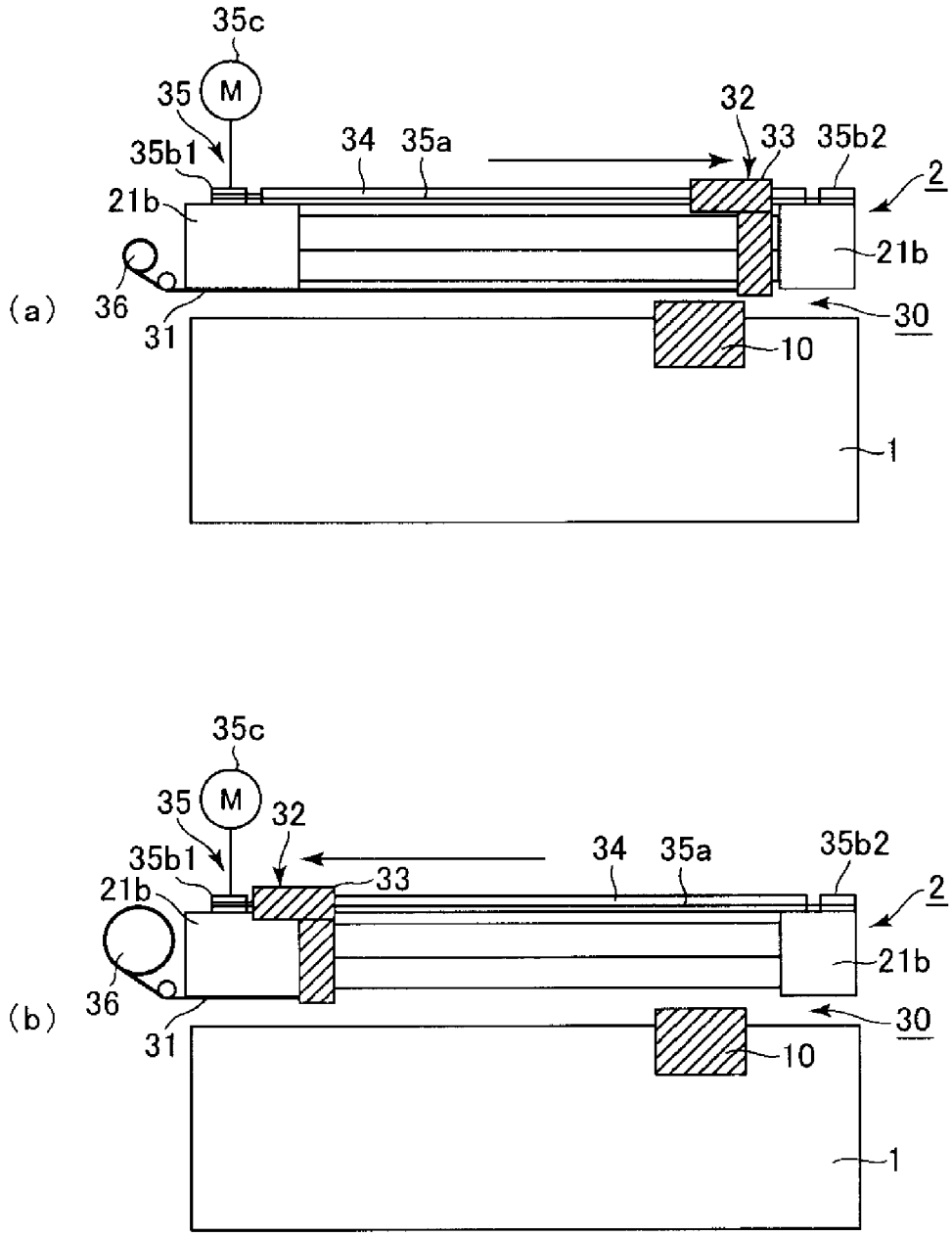

Parts (a) and (b) of FIG. 4 are schematic side views of the primary charger and its periphery in the image forming apparatus as seen in a widthwise direction.

Figure 5:
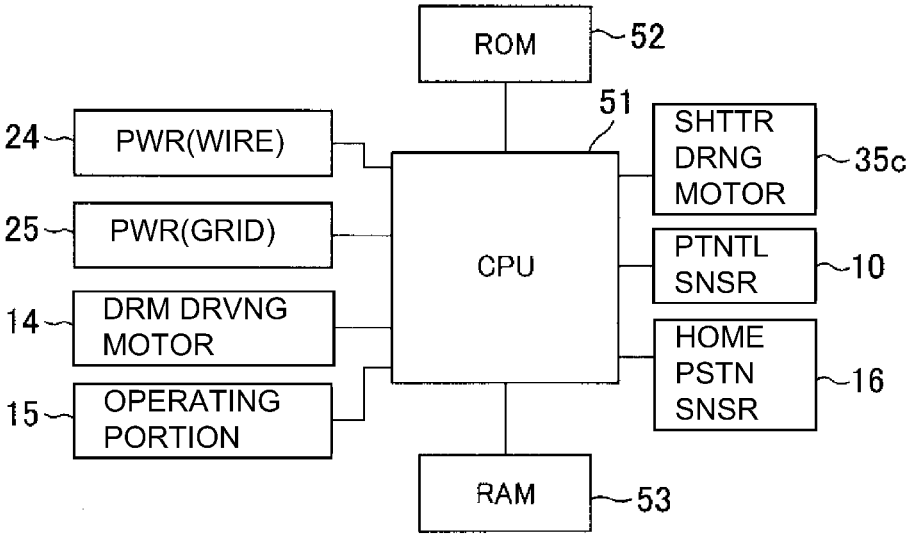

FIG. 5 is a schematic control black diagram showing an example of a detecting operation of an opening and closing state of a charger shutter in the present invention.

Figure 6:
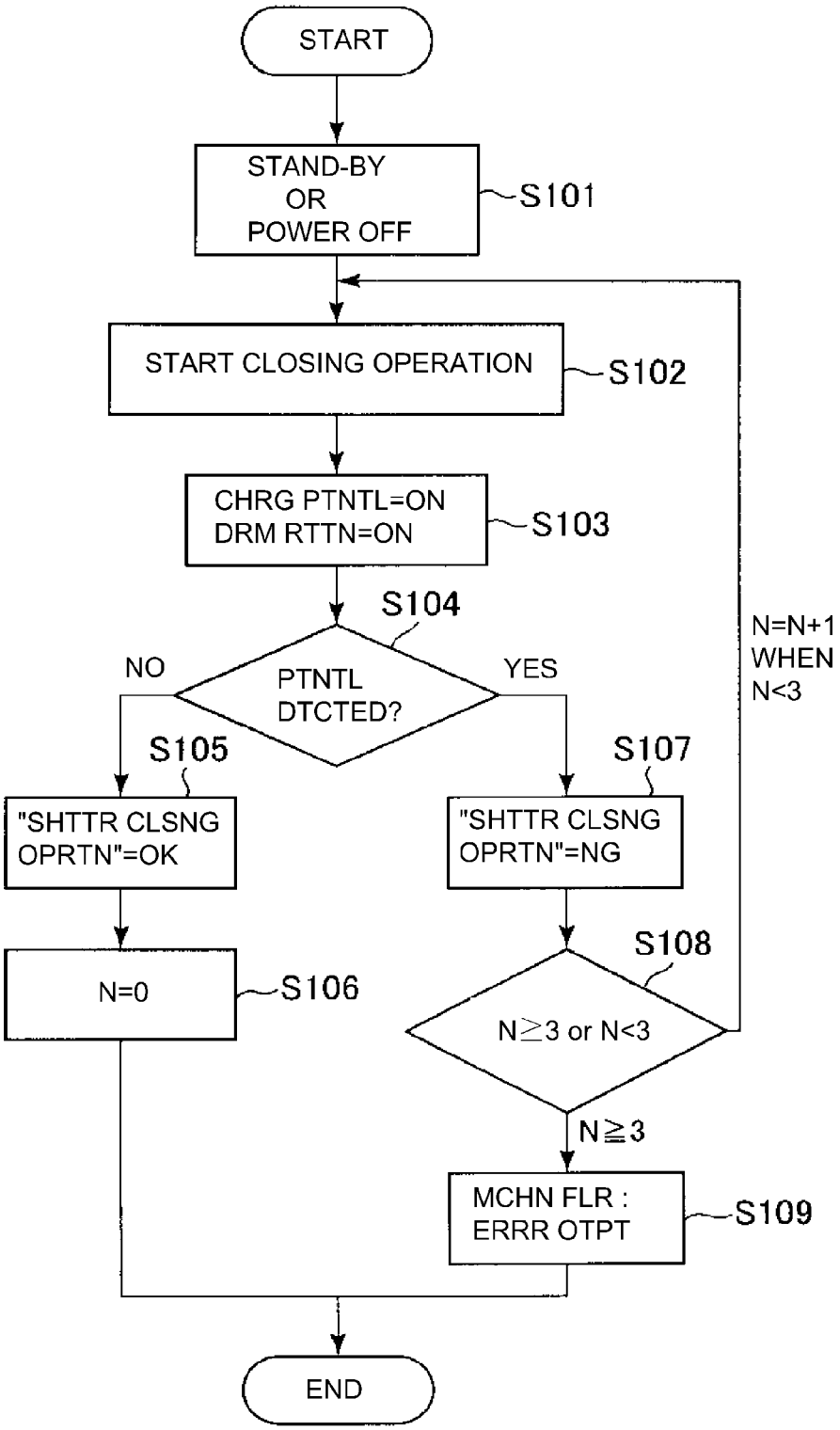

FIG. 6 is a flow chart of the example of the detecting operation of the opening and closing state of the charger shutter in the present invention.

Figure 7:
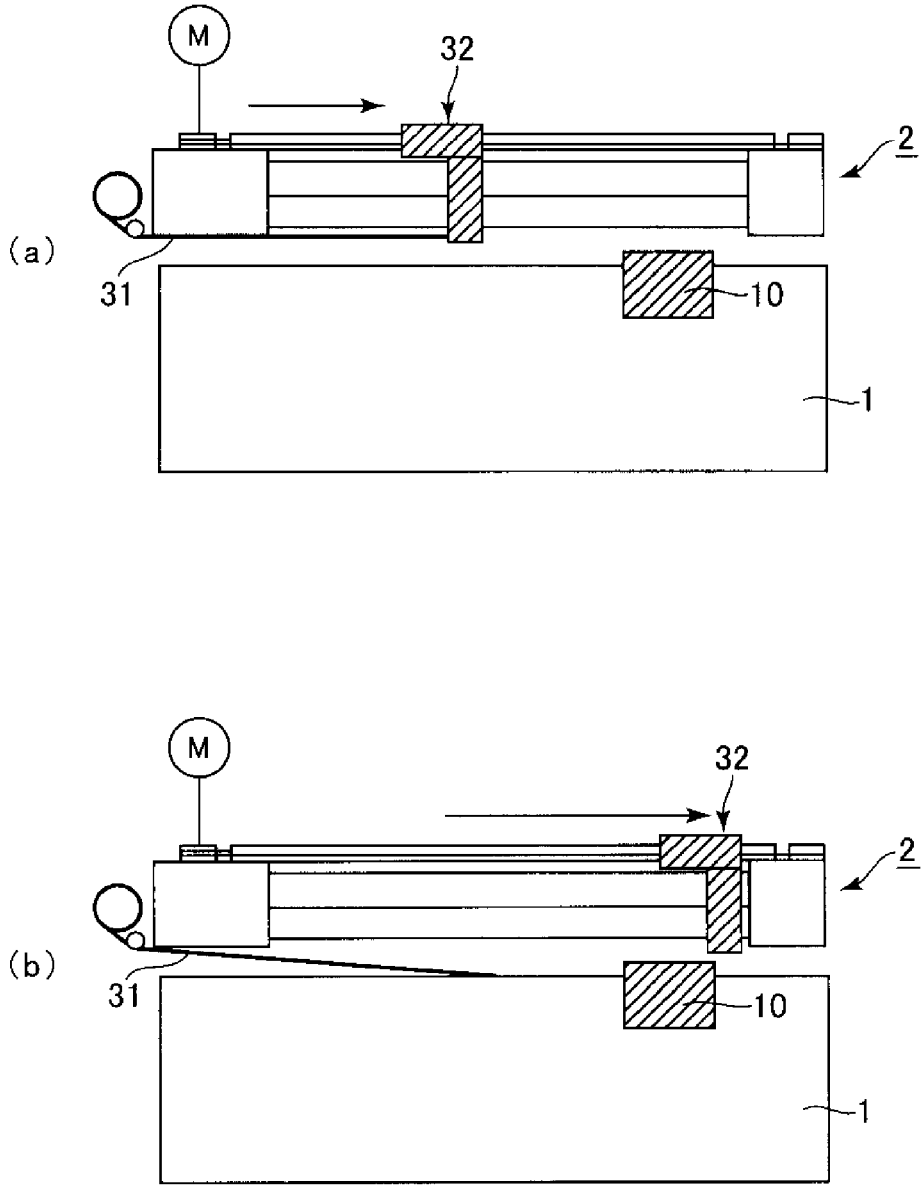

Parts (a) and (b) of FIG. 7 are schematic views for illustrating an example of a failed state of the charger shutter.

Figure 8:
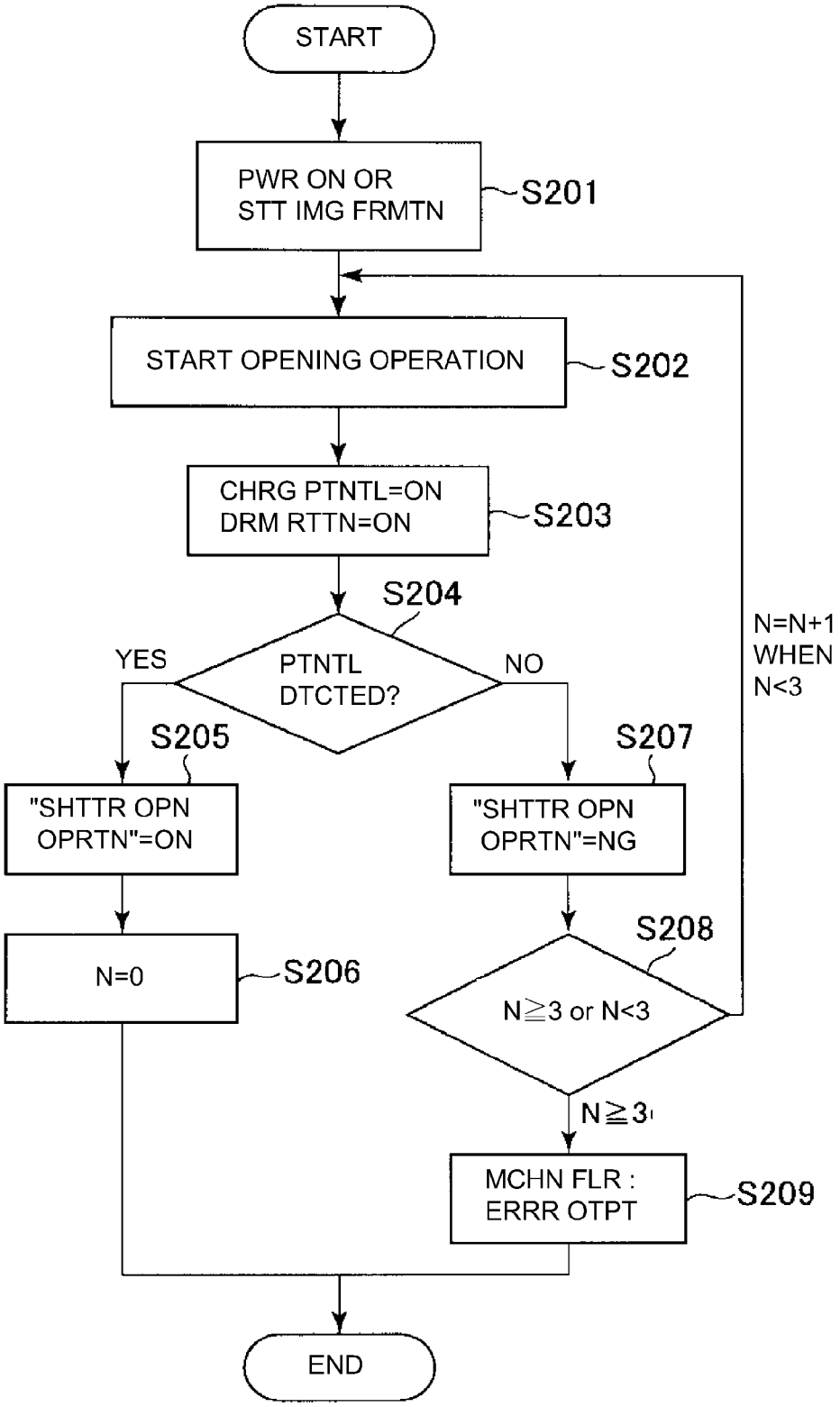

FIG. 8 is a flow chart of another example of the detecting operation of the opening and closing state of the charger shutter in the present invention.

Figure 9:
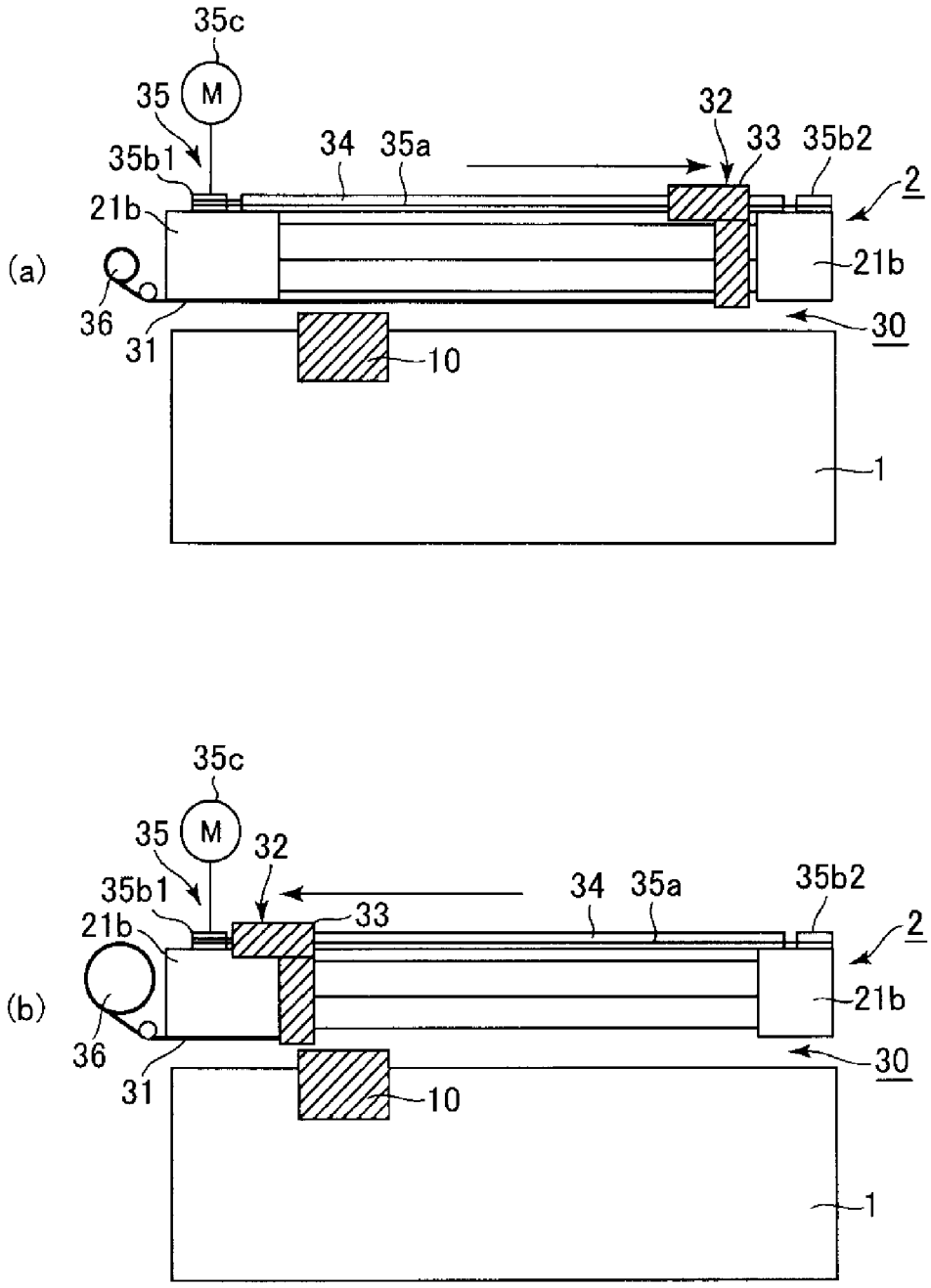

Parts (a) and (b) of FIG. 9 are schematic side views of the primary charger and its periphery in the image forming apparatus according to another embodiment of the present invention as seen in the widthwise direction.

Figure 10:
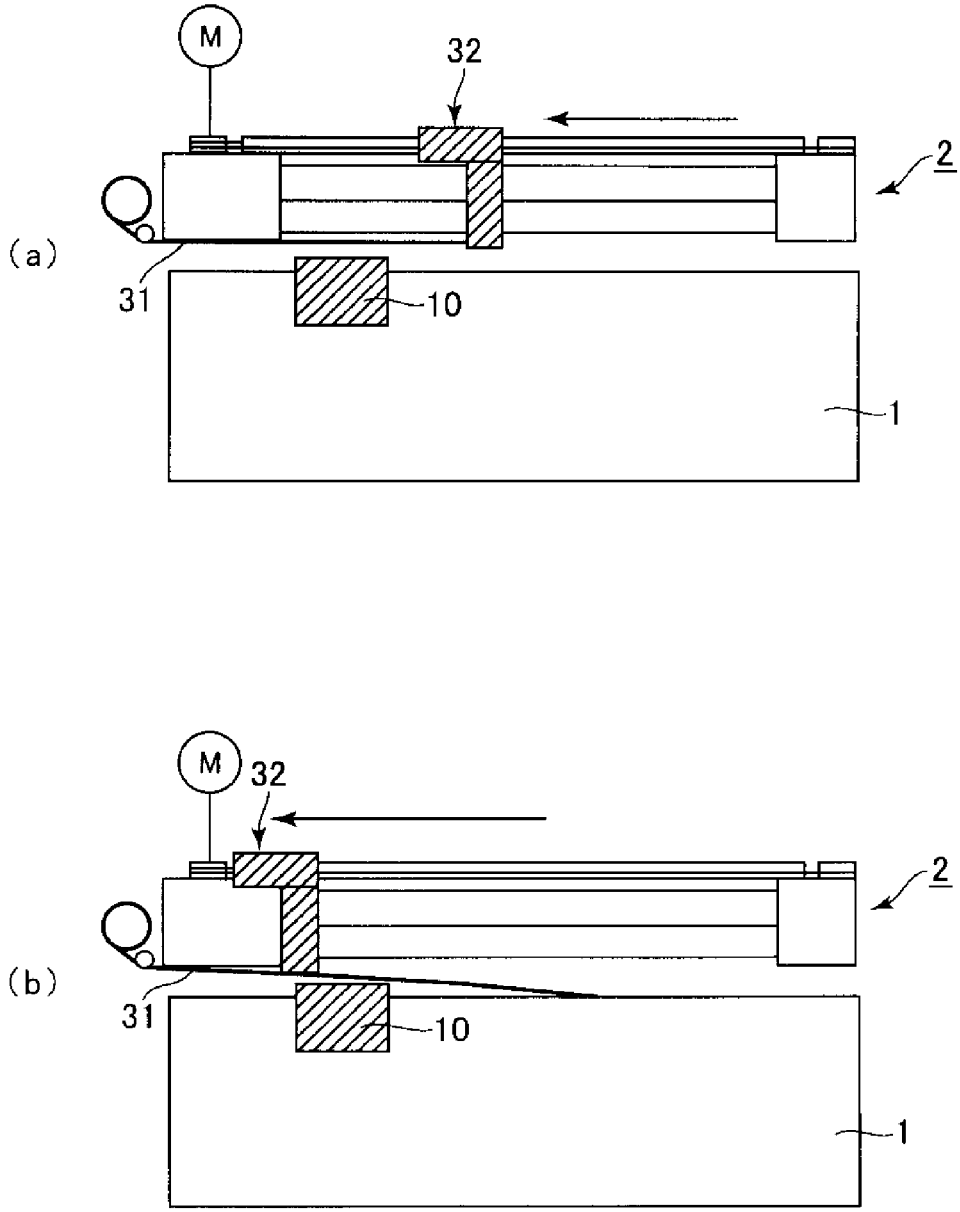

Parts (a) and (b) of FIG. 10 are schematic views for illustrating another example of the failed state of the charger shutter.

Figure 11:
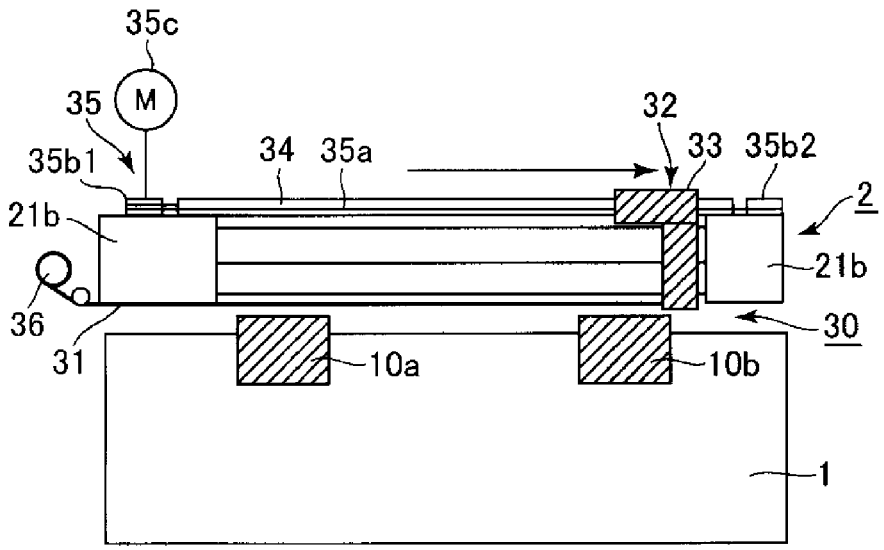

FIG. 11 is a schematic side view of the primary charger and its periphery in the image forming apparatus according to another embodiment of the present invention as seen in the widthwise direction.

Figure 12:
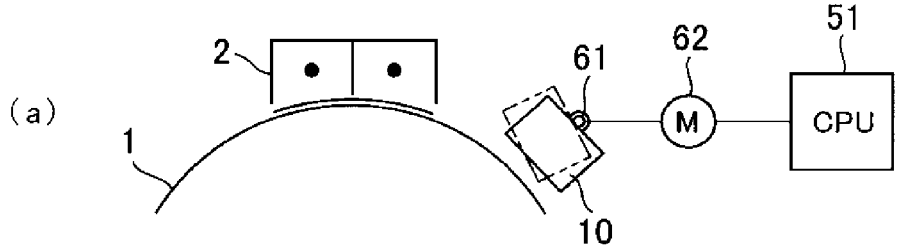
Figure 12:
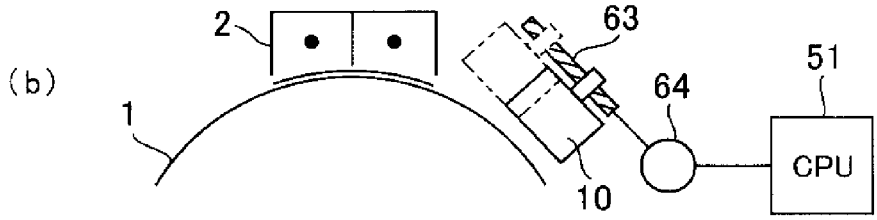

Parts (a) and (b) of FIG. 12 are schematic views showing an example of a constitution for changing an angle or position of the primary charger.

Figure 13:
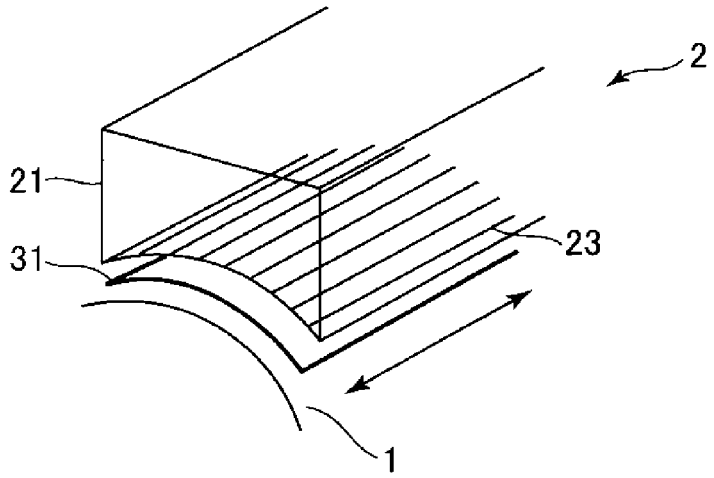

FIG. 13 is a schematic view for illustrating an example of a shape of the charger shutter moved along the longitudinal direction of the photosensitive drum.

DESCRIPTION OF THE PREFERRED EMBODIMENTS

Embodiment 1

1. General Structure and Operation of Image Forming Apparatus

Figure 1:
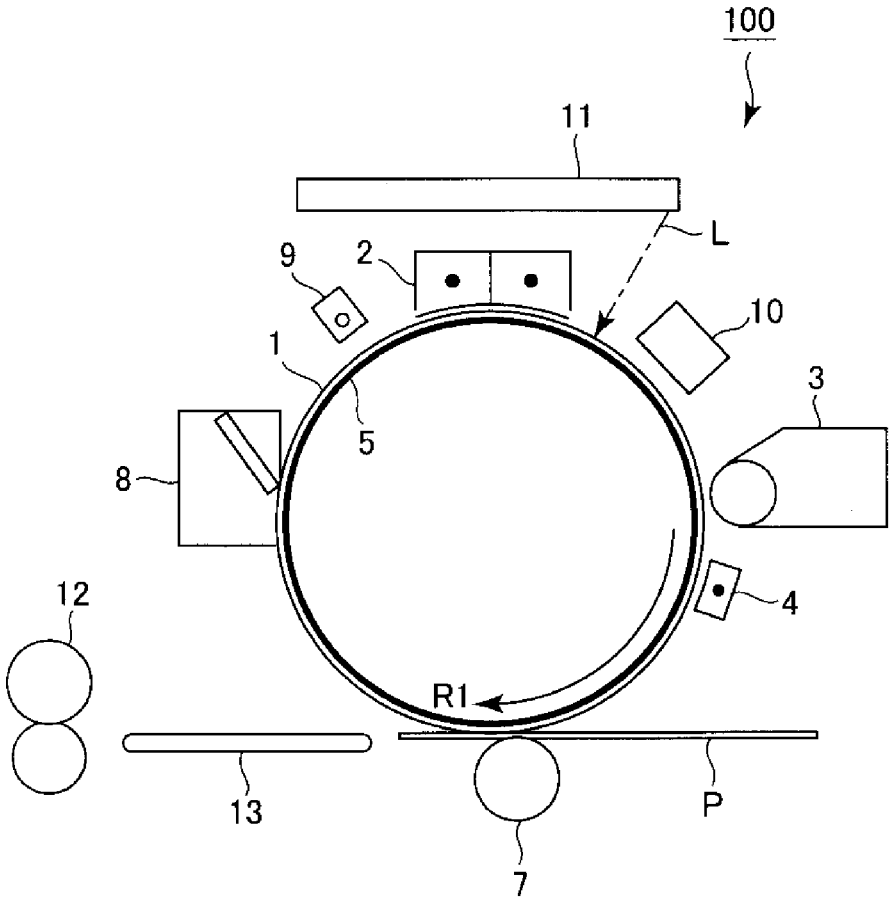
FIG. 1 is a schematic sectional vie of an image forming apparatus according an embodiment of the present invention.

FIG. 1 shows a schematic structure of an image forming apparatus 100 in this embodiment according to the present invention. In this embodiment, the image forming apparatus 100 is a laser printer of an electrophotographic type.

The image forming apparatus 100 includes a drum-type rotatable electrophotographic photosensitive member as an image bearing member, i.e., a photosensitive drum 1. The photosensitive drum 1 is rotationally driven in an arrow R1 direction. Around the photosensitive drum 1, along the rotational direction of the photosensitive drum 1, the following means are provided. A primary charger 2 as a primary charging means, a potential sensor 10 as a potential positioning means for measuring a surface potential of the photosensitive drum 1, a developing device 3 as a developing means, a pre-transfer charger 4 as a pre-transfer means, a transfer roller as a transfer means, a cleaning device 8 as a cleaning means, and a discharging exposure lamp 9 as a discharging means are provided. Further, above between the connect 2 and the developing device 3, an exposure device (laser scanner) 11 as an exposure means is provided. Further, at a downstream side of the transfer roller 7 with respect to a transfer material P such as a recording sheet, a fixing device 12 as a fixing means is provided. In this embodiment, the primary charger 2 and the pre-transfer charger 4 are corona chargers. Further, the potential sensor 10 detects the surface potential of the photosensitive drum 1 at a position downstream of a charging position of the surface of the photosensitive drum 1 by the photosensitive drum 1 (and also downstream of an exposure position by the exposure device 11) and upstream of a detecting position by the detecting device 3.

Figure 2:
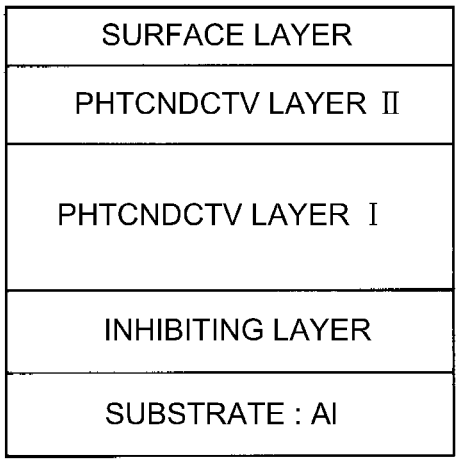
FIG. 2 is a schematic vie for illustrating an example of a layer structure of a photosensitive member.

Incidentally, in this embodiment, the photosensitive drum 1 is an a-Si (amorphous silicon) photosensitive member of 80 mm in diameter. As shown in FIG. 2, the photosensitive drum 1 is constituted by successively laminating an inhibiting layer, a photoconductive layer I, a photoconductive layer II and a surface layer on a cylindrical substrate (base member) of an electroconductive material (aluminum in this embodiment). Each of the photoconductive layers I and II is formed principally of an amorphous silicon material containing hydrogen and halogen atoms. Incidentally, the type of the photosensitive member is not limited to the drum type but may also be a belt-like type.

Inside the photosensitive drum 1, a drum heater 5 is provided. In this embodiment, in an environment in which an absolute water (moisture) content in the air is a certain value or more, energization to the drum heater 5 is turned on during the image forming operation. As a result, the surface of the photosensitive drum 1 is heated to prevent deposition of the corona product on the portion 1.

During the image forming operation, the photosensitive drum 1 is rotationally driven in the arrow R1 direction at a predetermined peripheral speed (process speed) by a driving device (not shown). The surface of the photosensitive drum 1 is electrically charged to a predetermined polarity and a predetermined potential by the primary charger 2 to which a charging bias is applied. Then, the charged surface of the photosensitive drum 1 is subjected to image exposure to light L depending on inputted image information by the exposure device 11. As a result, the surface potential of the photosensitive drum 1 is lowered at the portion image-exposed to the light L. Thus, an electrostatic latent image (electrostatic image) depending on the inputted image information is formed on the surface of the photosensitive drum 1. The electrostatic latent image formed on the surface of the photosensitive drum 1 is developed by the developing device 3. In this embodiment, the developing device 3 develops the electrostatic latent image formed on the surface of the photosensitive drum 1, into a toner image by depositing a toner charged to the same polarity as the charge polarity of the photosensitive drum 1 on the portion image-exposed to the light L.

The toner image formed on the surface of the photosensitive drum 1 is further enhanced in its charge polarity by the pre-transfer charger 4 and then is transferred onto a transfer material P by the action of the transfer roller 7. The transfer material P is, with predetermined timing, conveyed to a transfer nip formed between the photosensitive drum 1 and the transfer roller 7. With the timing when the transfer material P is conveyed to the transfer nip, a transfer bias which is a voltage of an opposite polarity to the normal charge polarity of the toner is applied to the transfer roller 7.

The transfer material P on which the toner image is transferred is conveyed to a conveying device 13 and then is further conveyed to a fixing device 12 by the conveying device 13. The transfer material P is heated and pressed by the fixing device, so that the toner image is fixed on the transfer material P and then the transfer material P is discharged to the outside of the image forming apparatus 100.

Separately, the toner (untransferred toner) remaining on the surface of the photosensitive drum 1 after the transfer step is removed from the surface of the photosensitive drum 1 by the cleaning device 8 to be collected. Further, residual electric charge on the surface of the photosensitive drum 1 is removed by light irradiation by the discharging exposure lamp 9, so that the photosensitive drum 1 is subjected to a subsequent image forming operation.

2. Primary Charger

Figure 3:
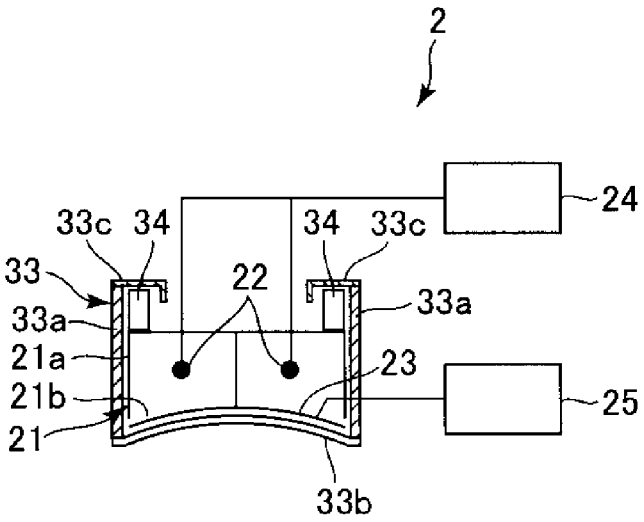
FIG. 3 is a schematic sectional view of a primary charger provided in the image forming apparatus as seen in a longitudinal direction.

FIG. 3 is a schematic sectional view of the primary charger 2 as seen in a longitudinal direction of the connect 2. Parts (a) and (b) of FIG. 4 are schematic side views of the primary charger 2 as seen in a widthwise direction of the primary charger 2.

The primary charger 2 is provided opposed to the photosensitive drum 1 along the longitudinal direction of the photosensitive drum 1 and charges the surface of the photosensitive drum 1 by electric discharge. The primary charger 2 include a shield case (hereinafter referred to as a shield) 21. The shield 21 includes a U-shaped shield body 21*a* provided with an opening 21*b* opposing the photosensitive drum 1 and includes blacks 21*b* and 21*b* for supporting the shield body 21*a* at longitudinal end portions of the shield body 21*a*. The shield body 21*a* of the shield 21 is formed of metal such as aluminum or stainless steel, and the blocks 21*b* and 21*b* at the longitudinal end portions are formed with an insulating member. Further, the primary charger 2 includes discharging wires 22 (two wires in this embodiment) as discharging electrodes at its inner portion. Each of discharging wire 22 is stretched between the blocks 21*b* and 21*b* along the longitudinal direction of the primary charger 2. In this embodiment, as the discharging wire 22, a tungsten wire was used. Further, the primary charger 2 includes a grid electrode 23 at the opening 21*b* of the shield 21 opposing the photosensitive drum 1. In this embodiment, as the grid electrode 23, a plate-like grid provided with a large number of openings formed by subjecting a thin stainless steel plate to etching was used.

In order to improve a charging efficiency, the grid electrode 23 has an arcuate shape which has curvature along the surface of the photosensitive drum 1.

To the discharging wires 22, a power source 24 is connected and a DC voltage is applied when the photosensitive drum 1 is charged. The power source 24 applies the voltage to the discharging wires 22, so that corona discharge occurs at the discharging wires 22. Further, to the grid electrode 23, a power source 25 is connected and a DC voltage is applied when the photosensitive drum 1 is charged. This voltage application is performed in order to stabilize an amount of ions moved from the discharging wires 22 toward the photosensitive drum 1. As a result, it becomes possible to charge the photosensitive drum 1 to a desired potential.

3. Shielding Device

In this embodiment, the image forming apparatus 100 includes a shielding device 30 for preventing the deposited matter from dropping from the primary charger 2 onto the photosensitive drum 1 during long-term stop of the image forming apparatus 100. The shielding device 30 includes the charger shutter 31 as a movable shielding member which can be disposed between the charger shutter 31 and the photosensitive drum 1 with desired timing and includes the shutter moving device 32 as a shielding member moving means for moving the charger shutter 31.

Here, as shown in FIG. 13, the photosensitive drum 1 has a cylindrical shape and its surface has the curvature. For that reason, in view of the charging efficiency, a shape of the surface of the grid electrode 23 of the primary charger 2 may desirably be the shape having the curvature along the surface of the photosensitive drum 1. For that reason, the charger shutter 31 is shaped to provide the curvature along the surface of the photosensitive drum 1, so that a further shielding effect can be expected.

As described later, in order to realize the charger shutter 31 having such a shape, the charger shutter 31 may preferably be inserted between the primary charger 2 and the photosensitive drum 1 from either of end portions of the primary charger 2 with respect to the longitudinal direction of the primary charger 2 (the rotational axis direction of the photosensitive drum 1). Further, in order to reduce a space of the charger shutter 31 during retraction, it is preferable that a sheet-like charger shutter 31 capable of being wound in a roll shape is used.

In the case where the sheet-like charger shutter 31 is used, during the long-term stop or the like of the image forming apparatus, the charger shutter 31 is inserted between the primary charger 2 and the photosensitive drum 1 from either of the longitudinal end portions of the primary charger 2 to be placed in the shielded state. In the shielded state, the whole opening 21*b* of the primary charger 2 is shielded by the charger shutter 31. The operation for moving the charger shutter 31 to close the opening 21*b* of the primary charger 2 is completed when the charger shutter 31 is placed in the shielded state. Further, during the image forming operation, the charger shutter 31 is placed in the retracted state by being wound up in the roll shape at the end portion of the primary charger 2. In the retracted state, there is no charger shutter 31 between the opening 21*b* of the primary charger 2 and the photosensitive drum 1. The operation for moving the charger shutter 31 to open the opening 21*b* of the primary charger 2 is completed when the charger shutter 31 is placed in the retracted state.

Incidentally, in this embodiment, the primary charger 2 and the pre-transfer charger 4 are the corona charger, and the shielding device 30 can be provided for both of the primary charger 2 and the pre-transfer charger 4. In this embodiment, the shielding device 30 provided for the primary charger 2 will be representatively described.

Further, in this embodiment, first, the charger shutter 31 can be placed in the shielded state in which the charger shutter 31 is disposed between the photosensitive drum 1 and the primary charger 2 so as to cover the opposing surface of the grid electrode 23 of the primary charger 2 opposing the photosensitive drum 1 ((a) of FIG. 4). Further, the charger shutter 31 can be placed in the retracted state in which the charger shutter 31 retracted from the position between the photosensitive drum 1 and the primary charger 2 so as not to cover the opposing surface of the grid electrode 23 of the primary charger 2 opposing the photosensitive drum 1 ((b) of FIG. 4). The charger shutter 31 is moved, by the shutter moving device 32, between the retracted state (position) and the shielded state (position) along the longitudinal direction of the primary charger 2. In this embodiment, the charger shutter 31 has the sheet-like shape and has the constitution in which the charger shutter 31 is wound up in the roll shape and retracted at one longitudinal end portion of the charger shutter 31 during the image forming operation. Further, in this embodiment, when the image forming operation is ended and the rotation of the photosensitive drum 1 is stopped, the charger shutter 31 wound up in the roll shape is pulled out toward the other longitudinal end portion of the charger shutter 31 to start the closing operation of the charger shutter 31.

That is, in this embodiment, the charger shutter 31 has the sheet-like shape movable between the retracted state position and the shielded state position. In the retracted state, the charger shutter 31 is wound up at a first end portion side with respect to the longitudinal direction of the photosensitive drum 1 to open the space between the photosensitive drum 1 and the primary charger 2. Further, in the shielded state, the charger shutter 31 is pulled out toward a second end portion side with respect to the longitudinal direction of the photosensitive drum 1 to shield the space between the detect 1 and the primary charger 2.

Incidentally, a side surface side where a door or the like used for performing an operation such as maintenance in an open state of the image forming apparatus in which the inside of the image forming apparatus is exposed is provided is the front side of the main assembly of the image forming apparatus 100. A side surface side opposite from the front side of the apparatus main assembly is the rear side. The longitudinal direction (rotational axis direction) of the photosensitive drum 1 and the longitudinal direction of the primary charger 2 extend from the front side toward the rear side of the apparatus main assembly. Hereinafter, with respect to the longitudinal end portions of the photosensitive drum 1 and the primary charger 2, the end portions at the front side and rear side of the apparatus main assembly are also referred simply to as a front-side end portion and a rear-side end portion, respectively.

The material for the charger shutter 31 may preferably be a chemically stable substance such that a component thereof is not deposited on the surface of the photosensitive drum 1 when the charger shutter 31 is contacted to the photosensitive drum 1. Further, the material for the charger shutter 31 may preferably be a material capable of being wound up in the roll shape. In this embodiment, as the material for the charger shutter 31, a 30 μm-thick polyimide sheet (film) satisfying the above conditions was used.

An end of the charger shutter 31 is bonded to a movable portion 33 described below constituting the shutter moving device 32. Further, the other end of the charger shutter 31 is bonded to a winding-up core 36 as a shielding member winding-up means urged in a winding-up direction of the charger shutter 31.

The movable portion 33 of the shutter moving device 32 includes supporting portions 33*a* and 33*a* provided opposed to each other at side surfaces of the shield 21 of the primary charger 2. Further, the movable portion 33 includes a sheet conveying member 33*b* which is provided opposed to the grid electrode 23 of the primary charger 2 and is connected between the supporting portions 33*a* and 33*a*. The sheet conveying member 33*b* has an arcuate shape having curvature along the arcuate shape of the surface of the grip electrode 23 opposing the photosensitive drum 1. The charger shutter 31 is fixed on the arcuate-shaped sheet conveying member 33*b* at its one end portion, so that the end portion is deformed in the arcuate shape along the shape of the sheet conveying member and the entire charger shutter 31 is deformed in the arcuate shape when being pulled and extended. Further, the movable portion 33 includes an engaging portion 33*c* which is provided at an upper portion of each of the supporting portions 33*a* and 33*a* and is slidably engaged with a rail 34 so as to movably hold the supporting portions 33*a* and 33*a* on the rail 34.

Further, the shutter moving device 32 includes the rails 34 and 34 extending in the longitudinal direction of the connect 2 at an upper portion of the shield 21 of the primary charger 2 at side surfaces. The movable portion 33 is movably engaged with the rails 34 and 34 and thus can be reciprocated along the longitudinal direction of the primary charger 2.

Further, the shutter moving device 32 includes a driving portion 35 for moving the movable portion 33. The driving portion 35 includes a driving wire 35*a* which is fixed to one supporting portion 33*a* of the movable portion 33 and is provided so as to penetrate the other supporting portion 33*a*. Further, the driving portion 35 includes pulleys 35*b*1 and 35*b*2 provided at an upper portion of the blocks 21*b* and 21*b* provided at longitudinal end portions of the shield 21. The driving wire 35*a* is wound around the pulleys 35*b*1 and 35*b*2 and the above-described one supporting portion 33*a* is fixed at an intermediate position between the pulleys 35*b*1 and 35*b*2. One pulley 35*b*1 (at the front side which is the same side as the side where the charger shutter 31 is to be wound up) is a driving pulley to which a driving force is to be transmitted, and the driving wire 35*a* is wound plural times about the driving pulley 35*b*1. Further, the driving portion 35 includes a motor 35*c* as a driving source for transmitting the driving force to the driving pulley 35*b*1. The driving pulley 35*b*1 is rotated by the motor 35*c*, so that when the driving wire 35*a* is driven, the movable portion 33 is moved along the longitudinal direction of the primary charger 2. In this embodiment, by forward rotation of the driving pulley 35*b*1, the movable portion 33 is moved toward the front side of the primary charger 2 and by reverse rotation of the driving pulley 35*b*1, the movable portion 33 is moved toward the rear side of the primary charger 2.

When the movable portion 33 is moved toward the rear side of the primary charger 2 along the rail 34, the charger shutter 31 is moved toward the rear side of the primary charger 2. As a result, the charger shutter 31 is inserted between the primary charger 2 and the photosensitive drum 1. The charger shutter 31 follows the shape of the sheet conveying member 33*b* and is inserted between the primary charger 2 and the photosensitive drum 1 with the shape having the curvature along the arcuate shape of the grid electrode 23 of the primary charger 2. In this case, in order to maintain a state in which the electric discharge product is less liable to be leaked from a gap between the charger shutter 31 and the primary charger 2, the charger shutter 31 may desirably be subjected to the opening and closing operation while keeping the shape following the arcuate shape of the grid electrode 23 of the primary charger 2.

Thus, in this embodiment, the sheet-shaped charger shutter 31 is configured to be moved along the longitudinal direction of the primary charger 2. As a result, the charger shutter 31 can be placed in the shielded state while keeping the arcuate shape following the surfaces of the grid electrode 23 and the photosensitive drum 1. Further, in this embodiment, the charger shutter 31 can be moved to the shielded state position or the retracted state position while keeping the arcuate shape state. Therefore, a further shielding effect can be obtained more than that in the case where the charger shutter 31 has a flat surface shape. Further, in this embodiment, by employing a constitution in which the sheet-shaped charger shutter 31 is wound up in the roll shape, it is possible to reduce the space of the charger shutter 31 during the retraction.

4. Charging Shutter Opening and Closing State Detecting Constitution

Next, a means for detecting the opening and closing state of the charger shutter 31 will be described.

With respect to the detection of the operation of the charger shutter 31, it is desirable that the open state and the closed state are detected.

That is, it is important that the charger shutter 31 is completely retracted before the image forming operation and is reliably inserted between the surfaces of the primary charger 2 and the photosensitive drum 1 during the long-term stop of the image forming apparatus. As a detecting means for detecting these states, the following methods would be considered.

(i) At both longitudinal end portions of the primary charger 2, a home position sensor for detecting reaching of the shutter moving device 32 for moving the charger shutter 31 is provided to detect completion of the opening and closing operation of the charger shutter 31.

(ii) To the motor for driving the shutter moving device 31 for moving the charger shutter 31, a torque detecting means for detecting a driving torque of the motor to detect a change in motor driving torque, so that the completion of the opening and closing operation of the charger shutter 31 is detected.

However, in the methods (i) and (ii), there is a need to provide the home position sensor at both longitudinal end portions of the primary charger 2 or to provide a torque limiter to the shutter moving device 32. For that reason, the above methods (i) and (ii) are undesirable in terms of a simplification of the constitution, downsizing and cost reduction.

In the constitution in this embodiment, in order to detect the retracted state in which the charger shutter 31 is completely open, the home position sensor as described above is relatively easily provided at the front side of the image forming apparatus main assembly. However, in order to detect the shielded state in which the charger shutter 31 is completely closed, it is difficult to provide the home position sensor at the rear side of the image forming apparatus main assembly.

When the charger shutter 31 is not closed completely, the image flow occurs only at a portion corresponding to the unshielded surface of the photosensitive drum 1. For that reason, it is important that whether or not the charger shutter 31 is completely closed can be detected with a simple constitution.

Therefore, in this embodiment, by using the potential sensor 10 for detecting the potential of the portion of the photosensitive drum 1 capable of being charged by the primary charger 2, whether or not the charging operation is executed in the state in which the charger shutter 31 is present between the opening 21*b* of the primary charger 2 and the photosensitive drum 1 is detected. That is, in this embodiment, first, the charging operation capable of charging the photosensitive drum 1 is performed by the primary charger 2. By this charging operation, typically, in the case where there is no charger shutter 31 between the opening 21*b* of the primary charger 2 and the photosensitive drum 1, the surface of the photosensitive drum 1 can be uniformly charged similarly as during the image forming operation. Thereafter, the potential of the photosensitive drum 1 portion capable of being charged by the charging operation is detected by the potential sensor 10. Then, on the basis of a detection result of the potential sensor 10, whether or not the charging operation is executed in the state in which the charger shutter 31 is located between the photosensitive drum 1 and the opening 21*b* of the primary charger 2. This operation is performed by control through a CPU 51 (FIG. 5) as a control means. As a result, abnormality can be detected by detecting the presence of the charger shutter 31 (i.e., that the photosensitive drum 1 is not charged) in the case where the charger shutter 31 would be originally absent between the opening 21*b* of the primary charger 2 and the photosensitive drum 1 during the above charging operation. Further, abnormality can be detected by detecting the absence of the charger shutter 31 (i.e., that the photosensitive drum 1 is charged) in the case where the charger shutter 31 would be originally present between the opening 21*b* of the primary charger 2 and the photosensitive drum 1 during the above charging operation.

In this embodiment, the potential sensor 10 as the potential detecting means for detecting the surface potential of the photosensitive drum 1 is disposed at a rear side as one longitudinal end side of the photosensitive drum 1 and the primary charger 2, i.e., an endpoint side of movement of the charger shutter 31 to the shielding position. That is, the potential sensor 10 is disposed so as to detect the surface potential of the photosensitive drum 1, capable of being charged by the primary charger 2, at at least one longitudinal end portion of the photosensitive drum 1. Further, by using this potential sensor 10, whether or not the charger shutter 31 is in the shielded state in which the charger shutter 31 is completely closed.

That is, in the case where the charger shutter 31 is completely closed even when the photosensitive drum 1 is rotated under application of the same voltage as that during the image forming operation to the primary charger 2, the potential is not detected by the potential sensor 10. Therefore, when the potential is detected by the potential sensor 10, the charger shutter 31 is not in the shielded state in which the charger shutter 31 is completely closed.

This potential sensor 10 detects not only the shielded state in which the charger shutter 31 is completely closed but also the charge potential (Vd) and the exposed portion potential (Vl) during the normal image forming operation. Further, a detection result thereof is used for current setting of the primary charger 2 and adjustment of exposure amount (exposure power) of the exposure device 11 during the image forming operation. In this way, it is possible to reduce a particular sensor for detecting the shielded state of the charger shutter 31, so that it is possible to realize a simple constitution, downsizing and cost reduction.

Here, in this embodiment, the potential sensor 10 cannot detect, when the photosensitive drum 1 is stopped, the surface potential of the photosensitive drum 1 with accuracy even under application of the voltage to the primary charger 2. This is because in general, when potential noise of the primary charger 2 is received at the potential detecting position, the charge potential and the potential after the exposure cannot be properly measured and therefore the potential sensor 10 is disposed at a downstream side of the primary charger 2 with respect to the surface movement direction of the photosensitive drum 1.

Incidentally, the potential sensor 10 used in this embodiment is mounted at a position which is 2.5 mm distant from the surface of the photosensitive drum 1. Further, various settings for the potential sensor 10 are as follows.

Input voltage: 24 V

Measuring voltage range: −50 V to +750 V

Rising/falling time: 100 ms

Further, in this embodiment, the photosensitive drum 1 is rotated during the detecting in the shielded state of the charger shutter 31 and therefore the material for the charger shutter 31 may preferably have a proper strength. As described above, in this embodiment, as the material for the charger shutter 31, the 30 μm-thick polyimide sheet was used. When this charger shutter 31 is used, the charger shutter 31 is not broken even in the case where the detect 1 is temporarily rotated during the detection in the shielded state of the charger shutter 31.

Further, in this embodiment, in order to detect the retracted state in which the charger shutter 31 is completely open, a home position sensor is provided at a front side of the primary charger 2. As the home position sensor, available any constitution using a micro switch or a photointerruptor can be used. In this embodiment, the sensor using the microswitch was employed.

As in this embodiment, the constitution in which the potential sensor 10 is provided at the end point side of the movement of the charger shutter 31 to the shielding position is advantageous, since the end point side is the rear side of the image forming apparatus, in the case where it is difficult to provide the home position sensor.

5. Operation for Detecting Opening and Closing State of Charger Shutter

FIG. 5 is a block diagram showing a detecting operation of an opening and closing state of the charger shutter 31. In this embodiment, the CPU 51 as the control means of the controller for effecting integrated control of an overall operation of the image forming apparatus 100 has the function of controlling the detecting operation of the opening and closing state of the charger shutter 31. The CPU 51 controls the detecting operation of the opening and closing state of the charger shutter 31 in accordance with programs and data stored in ROM 52. Further, the CPU 51 stores data necessary for the control processing in RAM 53 and reads and uses the data. To the CPU 51, a motor 35*c* of the shutter moving device 32 is connected and the CPU 51 effects control of drive start and stop and the rotational direction. Further, to the CPU 51, the potential sensor 10 is connected and a detection result of the potential sensor 10 is inputted into the CPU 51. Further, to the CPU 51, a home position sensor 16 for the shutter moving device 32 is connected and a detection result of the sensor 16 is inputted into the CPU 51. Further, to the CPU 51, the operating portion 15 of the image forming apparatus is connected and predetermined display is displayed on the display screen of the operating portion 15 in the case where, e.g., the abnormality of the charger shutter 31 is detected. Further, to the charger shutter 31, the power sources 24 and 25 for the primary charger 2 and the driving motor 14 or the like for the photosensitive drum 1 are connected.

FIG. 6 is a flow chart showing an example of an position for detecting whether or not the charger shutter 31 is in the shielded state in which the charger shutter 31 is completely closed when the charger shutter 31 is closed.

After the image forming operation is ended, at the time when the image forming apparatus 100 enter a stand-by state or the power of the image forming apparatus 100 is turned off (S101), an operation for closing the charger shutter (hereinafter referred to as a shutter closing operation) is started (S102). Here, the stand-by state refers to a state in which the image forming apparatus 100 is held on standby for a subsequent print job (an image forming operation for forming the image on a single transfer material or a plurality of transfer materials in accordance with a single image forming operation start instruction) while turning on the power of the image forming apparatus 100.

After the shutter closing operation is performed for a predetermined time, an operation for checking whether or not the charger shutter 31 is in the shielded state in which the charger shutter 31 is completely closed (hereinafter referred to as a shutter closed-state checking operation) is performed. The predetermined time for which the shutter closing operation is performed is set in general as a driving time of the motor 35*c* necessary to change the state of the charger shutter 31 from the retracted state to the shielded state in which the charger shutter 31 is completely closed. In the shutter closed-state checking operation, the same voltage as that during the image forming operation is applied to the discharging wires 22 and the grid electrode 23 of the primary charger 2, and the photosensitive drum 1 is rotated (S103). Further, during the rotation of the photosensitive drum 1, the surface potential of the photosensitive drum 1 is detected by the potential sensor (S104). Here, in the shutter closed-state checking operation, the photosensitive drum 1 is rotated enough to detect by the potential sensor 10 the surface potential of the photosensitive drum 1 charged by the primary charger 2. Thereafter, in a rotating state of the photosensitive drum 1, the surface potential of the photosensitive drum 1 is potential sensor 10.

In the shutter closed-state checking operation, when the potential is not detected by the potential sensor 10, the charger shutter 31 is judged as being in the shielded state in which the charger shutter 31 is completely closed (shutter closing operation=OK) (S105). Then, the number (N) of detection "NG" occurrences stored in the RAM 53 is reset to zero (N=0) (S106) and then the shutter closing operation is ended. On the other hand, in the case where the potential is detected in S104, the charger shutter 31 is judged as being not in the shielded state in which the charger shutter 31 is completely closed (shutter closing operation=NG) (S107) and then the shutter closing operation and the shutter closed-state checking operation are performed again (S108). The shutter closing operation and the shutter closed-state checking operation are repeated up to three times. In the case where the shutter closing operation is still judged as being "NG" even after the repetition of three times, there is a possibility of an occurrence of failure of the motor 35*c* for the shutter moving device 32 ((a) of FIG. 7) or an occurrence of breakage of the charger shutter 31 ((b) of FIG. 7) and therefore an error message is displayed on the display portion of the operating portion 15 (S109).

Here, in this embodiment, depending on whether or not the potential is detected by the potential sensor 10, the opening and closing state of the charger shutter 31 is judged but the present invention is not limited thereto. Whether or not the potential (e.g., the charge potential (+600 in this embodiment) of the photosensitive drum 1 during the image forming operation) in a predetermined range is detected may also be judged. That is, with respect to the detection result of the potential sensor 10, the opening and closing state of the charger shutter 31 can be judged depending on whether or not the potential of a certain level as a threshold is detected.

Further, the condition of the voltage applied to the primary charger 2 in order to detect the opening and closing state of the charger shutter 31 may also be not identical to that during the image forming operation. The condition may only be required to permit the detection of the opening and closing state of the charger shutter 31 depending on whether or not the potential of the certain level is detected.

Incidentally, in this embodiment, the retracted state of the charger shutter 31 is checked by the home position sensor provided at the front side of the primary charger 2 but it is possible to check whether or not the charger shutter 31 is still in the shielded state when the charger shutter 31 is opened.

FIG. 8 is a flow chart showing an example of an position for detecting whether or not the charger shutter 31 is still in the shielded state when the charger shutter 31 is opened.

At the time when the power of the image forming apparatus 100 is turned on or an instruction to start the image forming operation of the image forming apparatus 100 in the stand-by state is provided (S201), an operation for opening the charger shutter (hereinafter referred to as a shutter opening operation) is started (S202).

After the shutter opening operation is performed for a predetermined time, an operation for checking whether or not the charger shutter 31 is in the retracted state in which the charger shutter 31 is completely opened (hereinafter referred to as a shutter open-state checking operation) is performed. The predetermined time for which the shutter closing operation is performed is set in general as a driving time of the motor 35*c* necessary to change the state of the charger shutter 31 from the shielded state to the retracted state in which the charger shutter 31 is completely open. In the shutter open-state checking operation, the same voltage as that during the image forming operation is applied to the discharging wires 22 and the grid electrode 23 of the primary charger 2, and the photosensitive drum 1 is rotated (S203). Further, during the rotation of the photosensitive drum 1, the surface potential of the photosensitive drum 1 is detected by the potential sensor (S204). Here, in the shutter open-state checking operation, the photosensitive drum 1 is rotated enough to detect by the potential sensor 10 the surface potential of the photosensitive drum 1 charged by the primary charger 2. Thereafter, in a rotating state of the photosensitive drum 1, the surface potential of the photosensitive drum 1 is potential sensor 10.

In the shutter open-state checking operation, when the potential is detected by the potential sensor 10, the charger shutter 31 is judged as being not in the shielded state (shutter opening operation=OK) (S205). Then, the number (N) of detection "NG" occurrences stored in the RAM 53 is reset to zero (N=0) (S206) and then the shutter opening operation is ended. On the other hand, in the case where the potential is not detected in S204, the charger shutter 31 is judged as being still in the shielded state (shutter opening operation=NG) (S207) and then the shutter opening operation and the shutter open-state checking operation are performed again (S208). The shutter opening operation and the shutter open-state checking operation are repeated up to three times. In the case where the shutter opening operation is still judged as being "NG" even after the repetition of three times, there is a possibility of an occurrence of failure of the motor 35*c* for the shutter moving device 32 or an occurrence of breakage of the charger shutter 31 and therefore an error message is displayed on the display portion of the operating portion 15 (S209).

As described above, according to this embodiment, it is possible to detect, by a simple constitution, that the charging operation is executed in the state in which the charger shutter 31 is present between the opening 21*b* of the primary charger 2 and the photosensitive drum 1. Particularly, in this embodiment, by using the portion 10, with the simple constitution, it is possible to detect that the charger shutter 31 is placed in the shielded state in which the charger shutter 31 is completely closed.

Embodiment 2

Next, Embodiment 2 of the present invention will be described. Basic constitutions and operations of the image forming apparatus in this embodiment are identical to those in Embodiment 1. Therefore, constitutional elements having the same or corresponding functions as those for the image forming apparatus in Embodiment 1 are represented by the same reference numerals or symbols and will be omitted from

DETAILED DESCRIPTION

Parts (a) and (b) of FIG. 9 are schematic side views of the primary charger 2 as seen in the widthwise direction of the primary charger 2.

In this embodiment, the potential sensor 10 as the potential detecting means for detecting the surface potential of the photosensitive drum 1 is disposed at a front side as one longitudinal end side of the photosensitive drum 1 and the primary charger 2, i.e., an endpoint side of movement of the charger shutter 31 to the retracted position. Further, by using this potential sensor 10, whether or not the charger shutter 31 is in the retracted state in which the charger shutter 31 is completely open.

That is, in the case where the charger shutter 31 is completely open when the photosensitive drum 1 is rotated under application of the same voltage as that during the image forming operation to the primary charger 2, the potential is detected by the potential sensor 10. Therefore, when the potential is not detected by the potential sensor 10, the charger shutter 31 is not in the retracted state in which the charger shutter 31 is completely open.

Incidentally, in this embodiment, similarly as in Embodiment 1, the description will be made on the precondition that the potential sensor 10 is provided at the front side in the case where the charger shutter 31 is opened toward the front side to be located at the retracted position. However, as in this embodiment, the constitution in which the potential sensor 10 is provided at the end point side of the movement of the charger shutter 31 to the retracted position is advantageous, since the end point side is the rear side of the image forming apparatus, in the case where it is difficult to provide the home position sensor.

First, an example of the operation for detecting whether or not the charger shutter 31 is in the retracted state in which the charger shutter 31 is completely open when the charger shutter 31 is opened will be described. A flow chart of this operation is the same as that shown in FIG. 8 and thus the operation will be described with reference to FIG. 8.

At the time when the power of the image forming apparatus 100 is turned on or when an instruction to start the image forming operation from the stand-by state is provided (S201), the operation for opening the charger shutter 31 (the shutter opening operation) is started (S202).

After the shutter opening operation is performed for a predetermined time, an operation for checking whether or not the charger shutter 31 is in the retracted state in which the charger shutter 31 is completely open (hereinafter referred to as a shutter open-state checking operation) is performed. The predetermined time for which the shutter closing operation is performed is set in general as a driving time of the motor 35*c* necessary to change the state of the charger shutter 31 from the shielded state to the retracted state in which the charger shutter 31 is completely open. In the shutter open-state checking operation, the same voltage as that during the image forming operation is applied to the discharging wires 22 and the grid electrode 23 of the primary charger 2, and the photosensitive drum 1 is rotated (S203). Further, during the rotation of the photosensitive drum 1, the surface potential of the photosensitive drum 1 is detected by the potential sensor (S204). Here, in the shutter open-state checking operation, the photosensitive drum 1 is rotated enough to detect by the potential sensor 10 the surface potential of the photosensitive drum 1 charged by the primary charger 2. Thereafter, in a rotating state of the photosensitive drum 1, the surface potential of the photosensitive drum 1 is potential sensor 10.

In the shutter open-state checking operation, when the potential is detected by the potential sensor 10, the charger shutter 31 is judged as being not in the retracted state in which the charger shutter 31 is completely open (shutter opening operation=OK) (S205). Then, the number (N) of detection "NG" occurrences stored in the RAM 53 is reset to zero (N=0) (S206) and then the shutter opening operation is ended. On the other hand, in the case where the potential is not detected in S204, the charger shutter 31 is judged as being not in the retracted state in which the charger shutter 31 is completely open (shutter opening operation=NG) (S207) and then the shutter opening operation and the shutter open-state checking operation are performed again (S208). The shutter opening operation and the shutter open-state checking operation are repeated up to three times. In the case where the shutter opening operation is still judged as being "NG" even after the repetition of three times, there is a possibility of an occurrence of failure of the motor 35*c* for the shutter moving device 32 ((a) or FIG. 10) or an occurrence of breakage of the charger shutter 31 ((b) of FIG. 10) and therefore an error message is displayed on the display portion of the operating portion 15 (S209).

Next, an example of an position for detecting whether or not the charger shutter 31 is still in the retracted state when the charger shutter 31 is closed will be described. A flow chart of this operation is the same as that shown in FIG. 6 and thus the operation will be described with reference to FIG. 6.

After the image forming operation is ended, at the time when the image forming apparatus 100 enter a stand-by state or the power of the image forming apparatus 100 is turned off (S101), the operation for closing the charger shutter (the shutter closing operation) is started (S102).

After the shutter closing operation is performed for a predetermined time, an operation for checking whether or not the charger shutter 31 is still in the retracted state in which the charger shutter 31 is completely open (hereinafter referred to as a shutter closed-state checking operation) is performed. The predetermined time for which the shutter closing operation is performed is set in general as a driving time of the motor 35*c* necessary to change the state of the charger shutter 31 from the retracted state to the shielded state in which the charger shutter 31 is completely closed. In the shutter closed-state checking operation, the same voltage as that during the image forming operation is applied to the discharging wires 22 and the grid electrode 23 of the primary charger 2, and the photosensitive drum 1 is rotated (S103). Further, during the rotation of the photosensitive drum 1, the surface potential of the photosensitive drum 1 is detected by the potential sensor (S104). Here, in the shutter closed-state checking operation, the photosensitive drum 1 is rotated enough to detect by the potential sensor 10 the surface potential of the photosensitive drum 1 charged by the primary charger 2. Thereafter, in a rotating state of the photosensitive drum 1, the surface potential of the photosensitive drum 1 is potential sensor 10.

In the shutter closed-state checking operation, when the potential is not detected by the potential sensor 10, the charger shutter 31 is judged as being not in the retracted state (shutter closing operation=OK) (S105). Then, the number (N) of detection "NG" occurrences stored in the RAM 53 is reset to zero (N=0) (S106) and then the shutter closing operation is ended. On the other hand, in the case where the potential is detected in S104, the charger shutter 31 is judged as being still in the retracted state in which the charger shutter 31 is completely closed (shutter closing operation=NG) (S107) and then the shutter closing operation and the shutter closed-state checking operation are performed again (S108). The shutter closing operation and the shutter closed-state checking operation are repeated up to three times. In the case where the shutter closing operation is still judged as being "NG" even after the repetition of three times, there is a possibility of an occurrence of failure of the motor 35*c* for the shutter moving device 32 or an occurrence of breakage of the charger shutter 31) and therefore an error message is displayed on the display portion of the operating portion 15 (S109).

As described above, according to this embodiment, similarly as in Embodiment 1, it is possible to detect, by a simple constitution, that the charging operation is executed in the state in which the charger shutter 31 is present between the opening 21*b* of the primary charger 2 and the photosensitive drum 1. Particularly, in this embodiment, by using the portion 10, with the simple constitution, it is possible to detect that the charger shutter 31 is placed in the retracted state in which the charger shutter 31 is completely open.

Embodiment 3

Next, Embodiment 3 of the present invention will be described. Basic constitutions and operations of the image forming apparatus in this embodiment are identical to those in Embodiments 1 and 2. Therefore, constitutional elements having the same or corresponding functions as those for the image forming apparatus in Embodiments 1 and 2 are represented by the same reference numerals or symbols and will be omitted from detailed description.

In Embodiments 1 and 2, the potential sensor 10 was provided at either one of the longitudinal end portions of the primary charger 2.

In this embodiment, the image forming apparatus 100 includes, as shown in FIG. 11, a first potential sensor 10*a* provided so as to be capable of detecting the surface potential of the photosensitive drum 1 at the front-side end portion and a second potential sensor 10*b* provided so as to be capable of detecting the surface potential of the photosensitive drum 1 at the rear-side end portion. In this embodiment, by using these two potential sensors 10*a* and 10*b*, the opening and closing state of the charger shutter 31 can be detected.

That is, by using the potential sensor 10*b* provided at the end point side (the rear side in this embodiment) where the charger shutter 31 is moved to the shielding position, similarly as in Embodiment 1, it is possible to detect whether or not the charger shutter 31 is in the shielded state when the charger shutter 31 is closed. Further, by using the potential sensor 10*a* provided at the end point side (the front side in this embodiment) where the charger shutter 31 is moved to the retracted position, similarly as in Embodiment 2, it is possible to detect whether or not the charger shutter 31 is in the retracted state when the charger shutter 31 is opened.

Incidentally, the threshold of the potential for judging the opening and closing state of the charger shutter 31 may be the same level or different levels with respect to detection results of the two potential sensors 10*a* and 10*b*.

Embodiment 4

Next, Embodiment 4 of the present invention will be described. Basic constitutions and operations of the image forming apparatus in this embodiment are identical to those in Embodiments 1 to 3. Therefore, constitutional elements having the same or corresponding functions as those for the image forming apparatus in Embodiments 1 to 3 are represented by the same reference numerals or symbols and will be omitted from detailed description.

In Embodiments 1 to 3, the photosensitive drum 1 was rotated for detecting the opening and closing state of the charger shutter 31.

In this embodiment, when the opening and closing state of the charger shutter 31 is detected, without rotating the photosensitive drum 1, the surface potential of the photosensitive drum 1 charged by the primary charger 2 can be detected.

Incidentally, also in this embodiment, the potential sensor 10 is provided so as to detect, during the image forming operation, the surface potential of the photosensitive drum 1 at a position located downstream of the charging position (and also downstream of the exposure position) and upstream of the developing position with respect to the surface movement direction of the photosensitive drum 1.

For example, as shown in (a) of FIG. 12, when the opening and closing state of the charger shutter 31 is detected, an angle of the potential sensor 10 can be tilted toward the primary charger 2 side. For this purpose, e.g., a rotatable rotation shaft 61 is fixed on the potential sensor 10 and is rotated by a motor 62 as a driving source controlled by the CPU 51, so that the potential sensor 10 can be inclined.

Further, as shown in (b) of FIG. 12, when the opening and closing state of the charger shutter 31 is detected, the potential sensor 10 can be moved to the neighborhood of the primary charger 2. For this purpose, e.g., a driven portion of the potential sensor 10 is threadably mounted on a driving screw 63 and then the driving screw 63 is rotated by a motor 64 as a driving source controlled by the CPU 51, so that the potential sensor 10 can be moved.

By employing such a constitution, without rotating the photosensitive drum 1, it becomes possible to detect the opening and closing state of the charger shutter 31 similarly as in Embodiments 1 to 3.

In the above, the present invention is described based on specific embodiments but is not limited to the above-described embodiments.

For example, in the above embodiments, the case where the potential sensor is disposed so as to be capable of detecting either one or both of the longitudinal end portions of the photosensitive member was described. As described above, as a result, the completion of the closing operation or opening operation can be detected with the simple constitution by using the potential sensor and thus the use of the potential sensor is preferable. However, the present invention is not limited to the case where the potential sensor is disposed so as to be capable of detecting the potential of the longitudinal end portion of the photosensitive member. For example, the potential sensor may also be disposed so as to be capable of detecting the potential of a longitudinal central portion of the photosensitive member between the longitudinal end portions. Also in this case, abnormality can be detected by detecting the presence of the charger shutter 31 (i.e., that the photosensitive drum 1 is not charged) in the case where the charger shutter 31 would be originally absent between the opening 21*b* of the primary charger 2 and the photosensitive drum 1 during the above charging operation. Further, abnormality can be detected by detecting the absence of the charger shutter 31 (i.e., that the photosensitive drum 1 is charged) in the case where the charger shutter 31 would be originally present between the opening 21*b* of the primary charger 2 and the photosensitive drum 1 during the above charging operation.

Further, in the above embodiments, the case where the present invention is applied to the primary charger is described as an example but may also be applied to another corona charger as described above. For example, the present invention is also applicable to the pre-transfer charger in the respective embodiments described above. Thus, in the case where the present invention is applied to another charger, to the charger, a voltage capable of charging the photosensitive drum by the charger when the opening and closing state of the charger shutter is detected is applied.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 191575/2010 filed Aug. 27, 2010, which is hereby incorporated by reference.

What is claimed is:

1. An image forming apparatus comprising:

a rotatable photosensitive member;

a corona charger, including an opening, for electrically charging said photosensitive member by effecting electric discharge via the opening;

a toner image forming portion for forming a toner image on said photosensitive member electrically charged by said corona charger;

a sheet-like shutter for opening and closing the opening of said corona charger;

moving means for moving said sheet-like shutter in a longitudinal direction of said corona charger;

a potential sensor for detecting a potential of a portion of said photosensitive member chargeable by said corona charger, wherein said potential sensor is provided so as to be capable of detecting a potential of an end portion, of a region of a surface of said photosensitive member chargeable by said corona charger with respect to a rotational axis direction of said photosensitive member, at a downstream side with respect to a direction in which said sheet-like shutter moves when said sheet-like shutter closes the opening;

a display portion for effecting display to an operator; and an executing portion for executing an operation in a mode in which the electric discharge by said corona charger is executed after said moving means effects control for closing said sheet-like shutter, and then a potential of the end portion of the surface of said photosensitive member opposing said corona charger when the electric discharge is executed is detected by said potential sensor, and thereafter, when the potential detected by said potential sensor is a predetermined value or more, error display is effected at said display portion.

2. An image forming apparatus comprising:

a rotatable photosensitive member;

a corona charger, including an opening, for electrically charging said photosensitive member by effecting electric discharge via the opening;

a toner image forming portion for forming a toner image on said photosensitive member electrically charged by said corona charger;

a sheet-like shutter for opening and closing the opening of said corona charger;

moving means for moving said sheet-like shutter in a longitudinal direction of said corona charger;

a potential sensor for detecting a potential of a portion of said photosensitive member chargeable by said corona charger, wherein said potential sensor is provided so as to be capable of detecting a potential of an end portion, of a region of a surface of said photosensitive member chargeable by said corona charger with respect to a rotational axis direction of said photosensitive member, at an upstream side with respect to a direction in which said sheet-like shutter moves when said sheet-like shutter closes the opening;

a display portion for effecting display to an operator; and an executing portion for executing an operation in a mode in which the electric discharge by said corona charger is executed after said moving means performs an operation for opening said sheet-like shutter, and then a potential of the end portion of the surface of said photosensitive member opposing said corona charger when the electric discharge is executed is detected by said potential sensor, and thereafter, when the potential detected by said potential sensor is a predetermined value or less, error display is effected at said display portion.

3. The apparatus according to claim 1, further comprising a home position sensor for detecting that said sheet-like shutter is located at a retracted position where said sheet-like shutter opens the opening.

4. The apparatus according to claim 3, wherein said moving means is connected with a longitudinal end portion of said sheet-like shutter in a downstream side with respect to the direction in which said sheet-like shutter moves when said sheet-like shutter closes the opening, and includes a moving portion movable along the longitudinal direction of said corona charger, and wherein said home position sensor detects, by detecting the moving portion, that said sheet-like shutter is located at the retracted position where said sheet-like shutter opens the opening.

* * * * *